US009625200B2

(12) United States Patent
Gu et al.

(10) Patent No.: US 9,625,200 B2
(45) Date of Patent: Apr. 18, 2017

(54) REFRIGERATOR WITH ICEMAKER AND ICEMAKER PROTECTION

(71) Applicant: SAMSUNG ELECTRONICS CO., LTD., Suwon-si (KR)

(72) Inventors: Yang Yeol Gu, Hwasun-gun (KR); Sung Cheol Kang, Gwangju-Si (KR); Jae Koog An, Gwangju-Si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 227 days.

(21) Appl. No.: 14/030,494

(22) Filed: Sep. 18, 2013

(65) Prior Publication Data

US 2014/0130537 A1 May 15, 2014

(30) Foreign Application Priority Data

Nov. 9, 2012 (KR) ..... 10-2012-0126389

(51) Int. Cl.
*F25D 3/02* (2006.01)
*F25C 1/04* (2006.01)
(Continued)

(52) U.S. Cl.
CPC ..... *F25C 1/04* (2013.01); *F25C 5/005* (2013.01); *F25C 1/22* (2013.01); *F25C 1/24* (2013.01);
(Continued)

(58) Field of Classification Search
CPC ..... F25C 1/04; F25C 1/22; F25C 1/24; F25C 5/005; F25C 5/187; F25C 5/18; F25C 5/182; F25C 2305/022; F25C 2400/04
(Continued)

(56) References Cited

U.S. PATENT DOCUMENTS 5,768,899 A 6/1998 Lee et al.
2006/0016205 A1* 1/2006 Tremblay ..... F25C 1/04 62/340
(Continued)

FOREIGN PATENT DOCUMENTS

JP 2001-116410 4/2001
JP 2006-105419 4/2006
(Continued)

OTHER PUBLICATIONS

European Search Report in Application No. 13186267.4-1605 / 2730865 dated May 18, 2016 (8 pages).
(Continued)

*Primary Examiner* — Orlando E Aviles Bosques
(74) *Attorney, Agent, or Firm* — Staas & Halsey LLP

(57) ABSTRACT

A refrigerator including: a freezer compartment; a drawer door to open/close the freezer compartment and has a storage box; and an ice maker installed at an upper side of the freezer compartment, the ice maker includes: an ice maker supporter combined with an upper wall of the freezer compartment; an electronic device case supported by the ice maker supporter and in which a driving motor is embedded; an ice-making tray supported by the electronic device case and; a temperature sensor installed adjacent to the ice-making tray to detect temperature; and a protection cover combined with the ice maker supporter to cover at least portions of a lower part of the ice-making tray and prevents an article stacked in the lower part of the ice-making tray from interfering with at least one of the ice-making tray, the temperature sensor, and the electronic device case when the drawer door slides.

9 Claims, 7 Drawing Sheets

(51) Int. Cl.

| | |
|---|---|
| ***F25C 5/00*** | (2006.01) |
| *F25C 1/22* | (2006.01) |
| *F25C 5/18* | (2006.01) |
| *F25C 1/24* | (2006.01) |
| *F25D 25/02* | (2006.01) |

(52) U.S. Cl.
CPC ..... *F25C 5/18* (2013.01); *F25C 5/182* (2013.01); *F25C 2305/022* (2013.01); *F25C 2400/04* (2013.01); *F25D 25/025* (2013.01); *F25D 2700/121* (2013.01)

(58) Field of Classification Search
USPC ..... 62/344
See application file for complete search history.

(56) References Cited

U.S. PATENT DOCUMENTS

| | | | | |
|---|---|---|---|---|
| 2008/0156022 | A1 | 7/2008 | LeClear et al. | |
| 2010/0050681 | A1* | 3/2010 | Ryu | F25C 1/00 62/344 |
| 2010/0199701 | A1* | 8/2010 | Yoon | F25C 5/007 62/344 |
| 2011/0000248 | A1 | 1/2011 | Jeong et al. | |
| 2011/0162404 | A1 | 7/2011 | Shin et al. | |
| 2012/0324919 | A1* | 12/2012 | Bortoletto | F25C 1/20 62/73 |

FOREIGN PATENT DOCUMENTS

| | | |
|---|---|---|
| JP | 2011-64373 | 3/2011 |
| KR | 1900-0018691 | 12/1990 |
| KR | 2003-0064030 | 7/2003 |

OTHER PUBLICATIONS

European Patent Office Action issued in European Patent Application No. 13186267.4-1605 dated Dec. 5, 2016 (6 pages).

* cited by examiner

REFRIGERATOR WITH ICEMAKER AND ICEMAKER PROTECTION

CROSS-REFERENCE TO RELATED APPLICATIONS

This application claims the priority benefit of Korean Patent Application No. 10-2012-0126389, filed on Nov. 9, 2012 in the Korean Intellectual Property Office, the disclosure of which is incorporated herein by reference.

BACKGROUND

1. Field

The following description relates to a refrigerator having an ice-making device, and more particularly, to a refrigerator capable of preventing damage of an ice maker due to an article accommodated in a storage container that slides in a storage compartment.

2. Description of the Related Art

In general, a refrigerator is a home appliance that keeps food fresh at a low temperature by supplying low-temperature cold air to a storage compartment in which food is stored, wherein the storage compartment is divided into a freezer compartment that is maintained at a freezing temperature or less and a refrigerator compartment that is maintained at a temperature that slightly exceeds the freezing temperature.

Recently, various large refrigerators have been released due to conveniences of life and the need of a storage space and are divided into general refrigerators, side-by-side refrigerators, and mixed type refrigerators depending on the arrangement of the refrigerator compartment and the freezer compartment and an installation structure of a door.

Also, a dispenser that a user draws out ice or water supplies from an outside is disposed at the door of the refrigerator, and an ice-making device is disposed in the storage compartment so as to supply ice to the dispenser.

The ice-making device includes an ice-making tray in which ice is generated and an ice bank in which ice generated in the ice-making tray is stored. Ice generated in the ice-making tray is separated from the ice-making tray and then is stored in the ice bank disposed at a lower portion of the ice-making device.

SUMMARY

Therefore, it is an aspect of the present disclosure to provide a refrigerator capable of preventing damage of an ice maker due to an article stored in a storage container when the storage container slides in and out of a storage compartment.

Additional aspects of the disclosure will be set forth in part in the description which follows and, in part, will be apparent from the description, or may be learned by practice of the disclosure.

In accordance with one aspect of the present disclosure, there is provided a refrigerator including: a freezer compartment; a drawer door that is capable of sliding in and out of the freezer compartment so as to open/close the freezer compartment and has a storage box in which an article is stored; and an ice maker that is installed at an upper side of the freezer compartment, wherein the ice maker includes: an ice maker supporter that is combined with an upper wall of the freezer compartment; an electronic device case which is supported by the ice maker supporter and in which a driving motor is embedded; an ice-making tray that is supported by the electronic device case and the ice maker supporter to be rotatable by the driving motor; a temperature sensor that is installed adjacent to the ice-making tray so as to detect temperature of the ice-making tray; and a protection cover that is combined with the ice maker supporter so as to cover at least portions of a lower part of the ice-making tray and prevents an article stacked in the lower part of the ice-making tray from interfering with at least one of the ice-making tray, the temperature sensor, and the electronic device case when the drawer door slides.

The protection cover may include a front side part that is combined with the ice maker supporter so as to cover portions of a front of the electronic device case, a cover part that covers portions of the lower part of the ice-making tray, and a rear side part that faces the front side part and is supported at a rear side of the ice maker supporter, and downwardly-inclined inclination guide parts may be disposed in corner regions of lower ends of the front side part and the rear side part.

The protection cover may be separably combined with the ice maker supporter.

The cover part may be spaced apart from a bottom surface of the ice-making tray by a predetermined distance, and a downwardly-inclined surface may be formed at the cover part and may guide ice separated from the ice-making tray downward.

The ice-making tray may be formed as a resin injection molding structure, and ice generated in the ice-making tray may be separated by twisting due to a rotational force of the driving motor.

The refrigerator may further include: an accommodation basket that is slidably installed at an upper part of the storage box; and an ice bank which is separably accommodated in a storage space of the accommodation basket and in which ice dropping from the ice-making tray is stored.

Cutting parts having sizes corresponding to the ice maker may be formed at rear walls of the accommodation basket and the ice bank so as to prevent collision with the ice maker when the accommodation basket slides.

In accordance with another aspect of the present disclosure, there is provided a refrigerator including: a freezer compartment; an ice maker including an ice maker supporter that is combined with an upper side of the freezer compartment and an ice-making tray that is supported by the ice maker supporter and is formed as a resin injection molding structure in which generated ice is separated by twisting due to a driving motor; an accommodation basket which is installed to be slidable from a lower part of the ice-making tray in a forward/backward direction of the freezer compartment and in which an article is stored; and a protection cover that is combined with the ice maker supporter so as to cover at least portions of the lower part of the ice-making tray, wherein inclination guide parts that guide the article to a lower side of the protection cover when the accommodation basket slides and a lower side of the ice-making tray is interfered with the article accommodated in the accommodation basket, are disposed in corner regions of front and rear lower ends of the protection cover.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
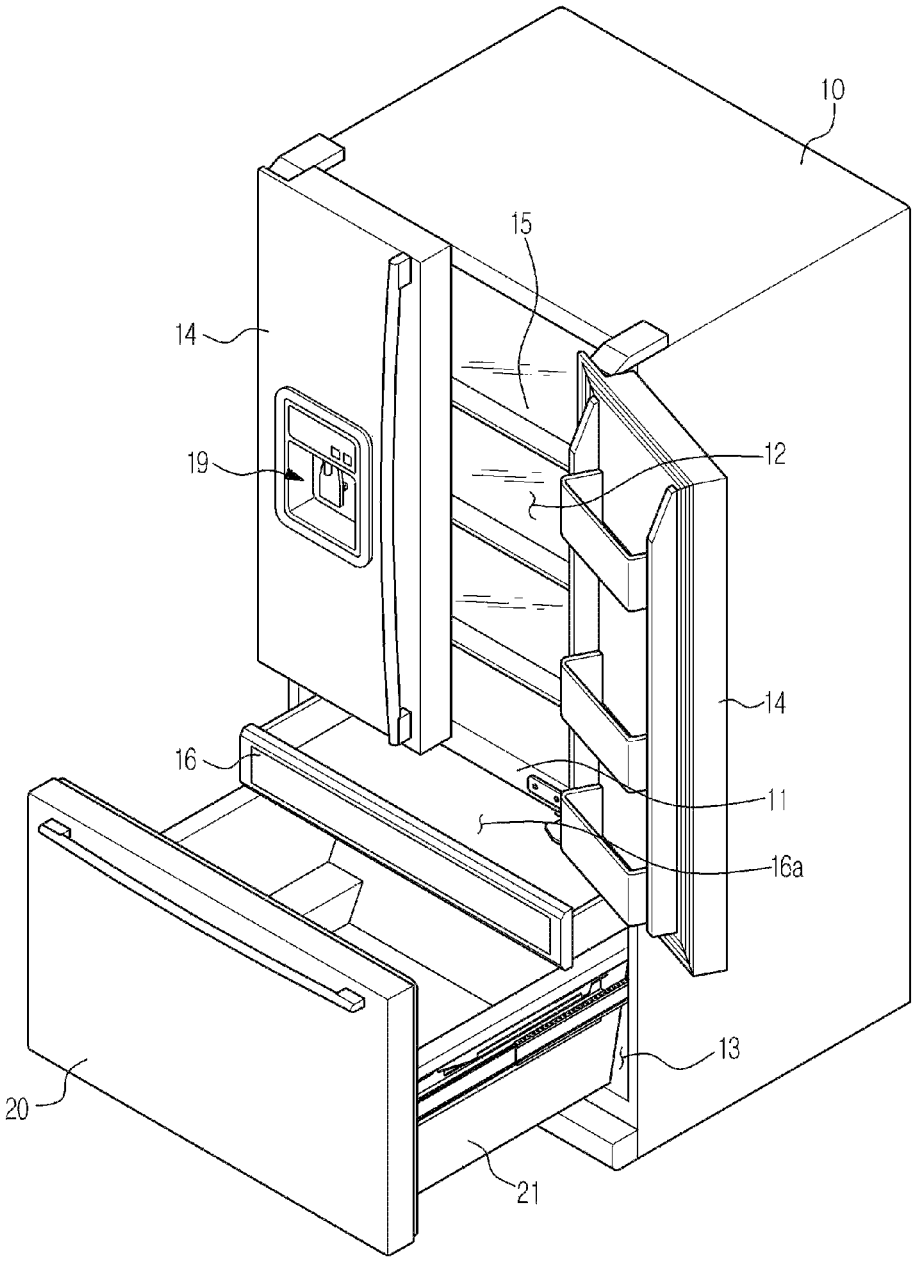
FIG. 1 is a view illustrating a state in which a door of a refrigerator is open/closed, according to an embodiment of the present disclosure.

Reference will now be made in detail to embodiments, examples of which are illustrated in the accompanying drawings, wherein like reference numerals refer to the like components throughout. Embodiments are described below to explain the present disclosure by referring to the figures.

The present disclosure will now be described more fully with reference to the accompanying drawings, in which exemplary embodiments of the disclosure are shown. The disclosure may, however, be embodied in many different forms and should not be construed as being limited to embodiments set forth herein; rather, these embodiments are provided so that this disclosure will be thorough and complete, and will fully convey the concept of the disclosure to those skilled in the art. In order to clearly describe the present disclosure, portions having no relation with description are omitted, and in the drawings, the widths, the lengths, and the thicknesses of components are exaggerated for conveniences. Like reference numerals refer to like components throughout.

Figure 2:
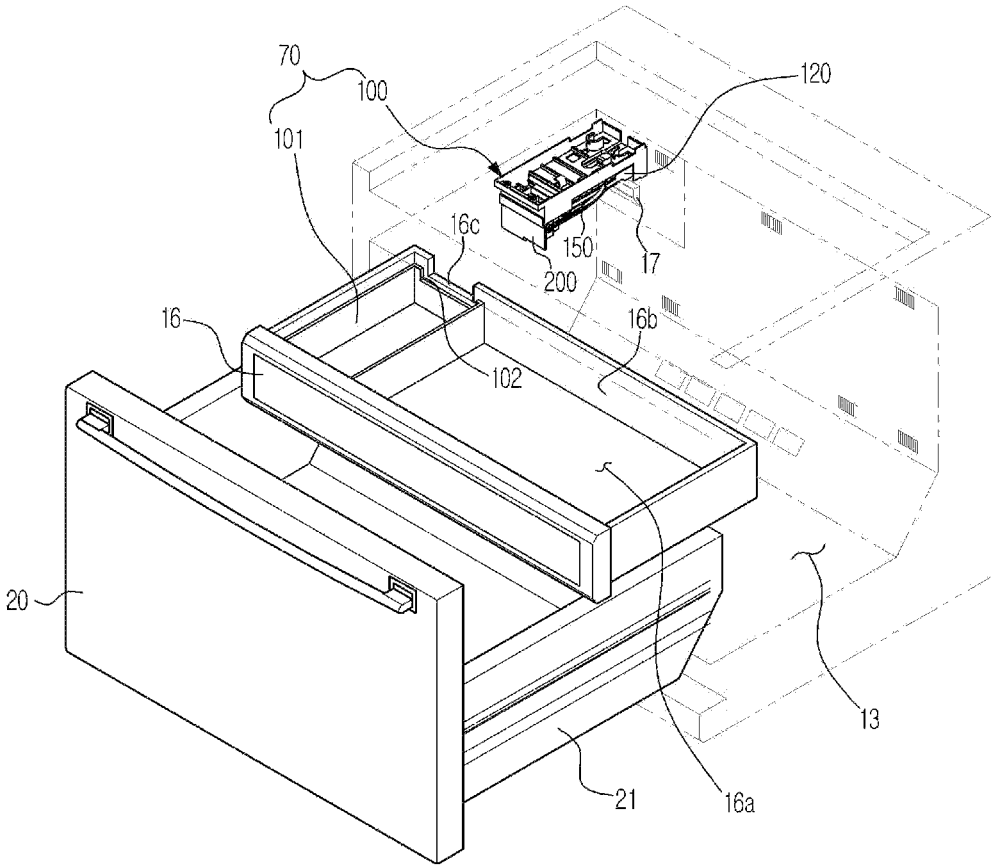
FIG. 2 is a schematic perspective view illustrating an ice maker disposed in a freezer compartment, according to an embodiment of the present disclosure.

FIG. 1 is a view illustrating a state in which a door of a refrigerator is open/closed, according to an embodiment of the present disclosure, and FIG. 2 is a schematic perspective view illustrating an ice maker disposed in a freezer compartment, according to an embodiment of the present disclosure.

Referring to FIGS. 1 and 2, the refrigerator according to an embodiment includes a body 10 that constitutes the exterior and includes first and second storage compartments 12 and 13 partitioned off into upper and lower parts by an insulation partition 11, a first storage compartment door 14 that is installed at a front side of the first storage compartment 12 and opens/closes the first storage compartment 12, and a second storage compartment door 20 that is installed at a front side of the second storage compartment 13 and opens/closes the second storage compartment 13.

The same components as those of a general refrigerator, such as a compressor (not shown), a condenser (not shown), an expansion unit (not shown), and an evaporator (not shown), which are required to form a refrigerating cycle, may be disposed in the body 10.

The first storage compartment 12 disposed at an upper part of the body 10 may be configured of a refrigerator compartment, and the second storage compartment 13 disposed at a lower part of the body 10 may be configured of a freezer compartment. Also, of course, each storage compartment 12 or 13 may be changed to a refrigerator compartment or a freezer compartment depending on an occasion.

A plurality of shelves 15 for accommodating food to be kept refrigerated are installed at the first storage compartment 12 and are spaced apart from each other by a predetermined distance. An accommodation basket 16 for accommodating food to be kept frozen may be installed at the second storage compartment 13.

A plurality of first storage compartment doors 14 that open/close the first storage compartment 12 are installed at both sides of the body 10 so as to be rotatable in right and left directions. A dispenser 19 may be disposed at the first storage compartment door 14 so as to discharge ice generated by an ice maker (not shown) disposed in the insulation partition 11 partitioned off from an upper side of the first storage compartment 12 or to discharge a beverage for drinking water.

The second storage compartment door 20 that opens/closes the second storage compartment 13 may be disposed in the form of a drawer door that is disposed to slide in the front of the second storage compartment 13, and a storage box 21 may be integrally or separably mounted on the second storage compartment door 20. When the second storage compartment door 20 is open, the storage box 21 is taken out of the front of the second storage compartment 13, an upper part of the storage box 21 is open such that a user may easily keep food in the storage box 21 or may easily take out food from the storage box 21 through the open upper part.

The accommodation basket 16 may be disposed at an upper part of the storage box 21, may be taken out of the front of the second storage compartment 13 together with the second storage compartment door 20 when the second storage compartment door 20 is open and may slide in and out of the upper part of the storage box 21 such that the accommodation basket 16 may slide in and out of the second storage compartment 13 separate from the storage box 21 in a state in which the storage box 21 is open.

An ice-making device 70 to generate ice may be disposed at an upper side of the second storage compartment 13. The ice-making device 70 is installed in an upper space of the second storage compartment 13 and includes an ice maker 100 in which supplied water is filled and cooled such that ice is generated and an ice bank 101 that is disposed at a lower part of the ice maker 100 so as to store ice separated from the ice maker 100. The ice bank 101 may be separably accommodated in one side of a storage space **16*a* of the accommodation basket 16**.

A first cutting part **16*c* and a second cutting part 102 may be formed at a rear wall 16*b* of the accommodation basket 16. The first cutting part 16*c* has a size corresponding to the ice maker 100 so as to prevent collision with the ice maker 100 when the accommodation basket 16 slides, and the second cutting part 102 has a height corresponding to the first cutting part 16*c* so as to prevent collision with the ice maker 100. The first and second cutting parts 16*c* and 102 allow cold air ejected from a cold air outlet 17 disposed at a rear wall of the second storage compartment 13 to be smoothly transferred to a lower side of the ice maker 100**.

Hereinafter, the ice maker 100 according to an embodiment of the present disclosure will be described with reference to FIGS. 3 through 5.

Figure 3:
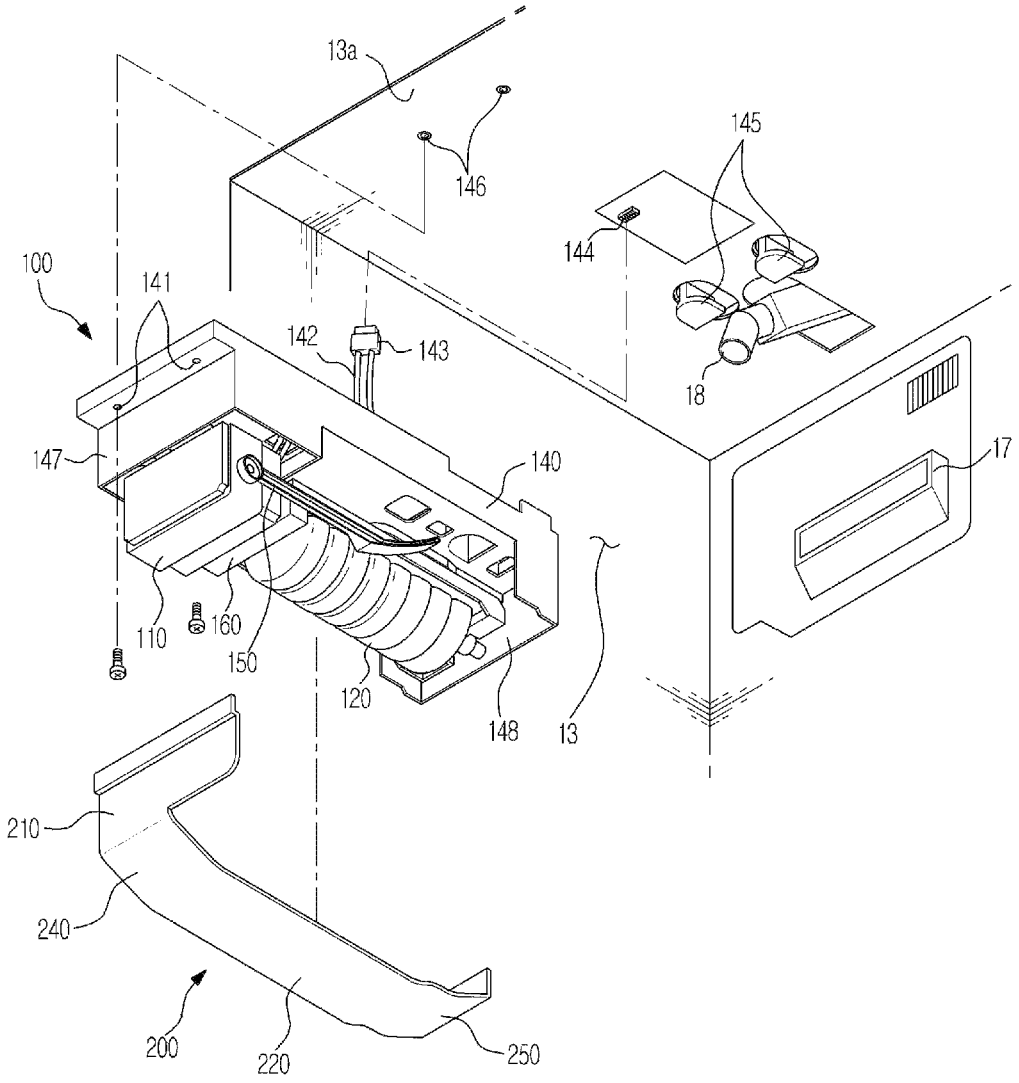
FIG. 3 is an exploded perspective view of the ice maker installed at the freezer compartment as illustrated in FIG. 2.
Figure 4:
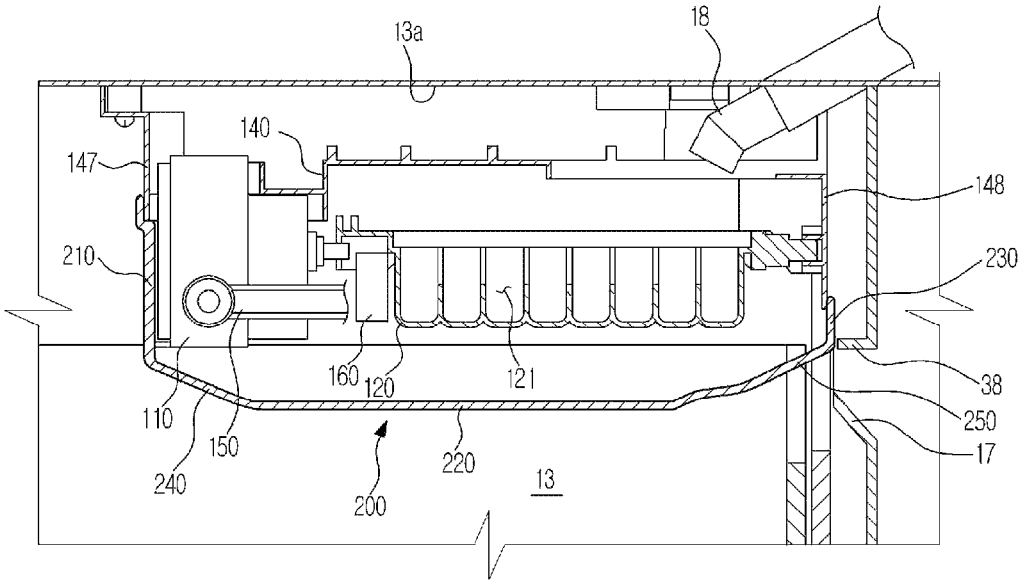
FIG. 4 is a view of the ice maker of FIG. 2 in a state in which the ice maker is installed at the freezer compartment.
Figure 5:
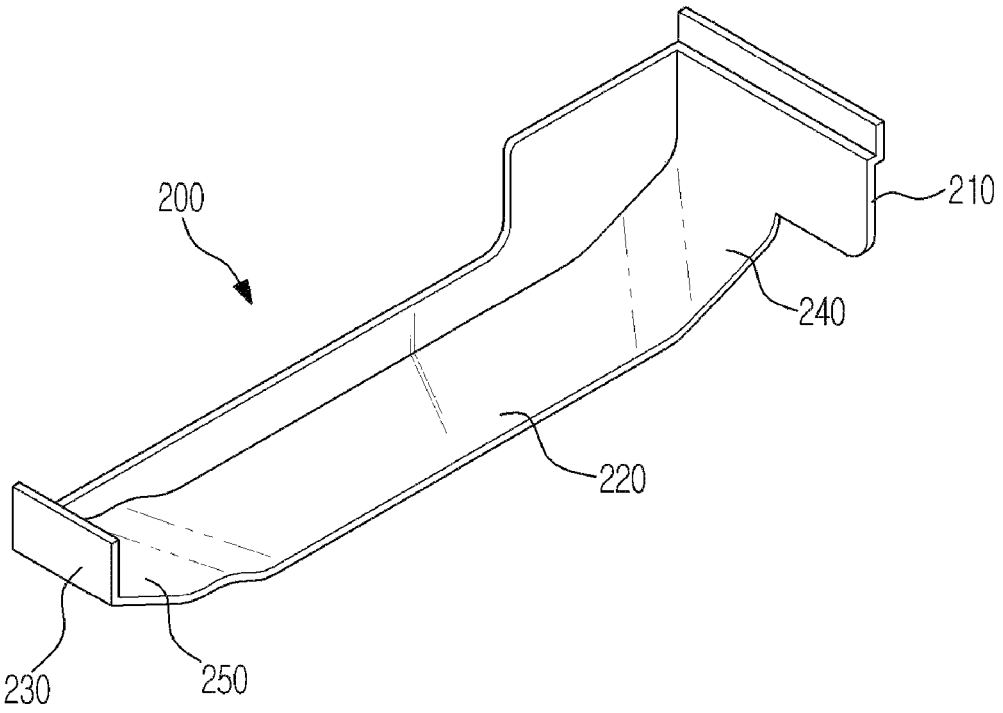
FIG. 5 is a perspective view illustrating a protection cover according to an embodiment of the present disclosure.

Referring to FIGS. 3 through 5, the ice maker 100 according to an embodiment of the present disclosure includes an electronic device case 110 in which various electronic devices are disposed, an ice-making tray 120 that is combined with a rear side of the electronic device case 110, an ice maker supporter 140 that supports the electronic device case 110 and the ice-making tray 120 and is combined with an upper space of the second storage compartment 13, and a protection cover 200 that is disposed to cover portions of a lower part of the ice-making tray 120.

A driving motor (not shown) to rotate the ice-making tray 120 and an ice full lever 150 and various electronic components and driving devices for controlling an operation of the ice maker 100 are disposed in the electronic device case 110. These electronic components and driving devices may include a circuit board for controlling the driving motor, a gear that reduces the speed of a rotational force of the driving motor, and the like.

Also, the ice full lever 150 may be installed at one side of the electronic device case 110 so as to detect whether the ice bank 101 is completely full. The ice full lever 150 moves upward/downward and detects whether the ice bank 101 is completely full, and detected information is transferred to a controller (not shown) of the body 10.

Water supplied via a water supply pipe 18 is accommodated in the ice-making tray 120, and ice is generated in the ice-making tray 120 using supplied cold air. A top portion of the ice-making tray 120 is open so that water may be supplied to the ice-making tray 120, and the ice-making tray 120 is formed as a resin injection molding structure in which a plurality of ice-making grooves 121 having approximately semicircular cross-sections are formed. Ice made in the plurality of ice-making grooves 121 is separated from the ice-making grooves 121 by the ice-making tray 120 twisted by rotation of the driving motor and drops downward. Also, a temperature sensor 160 for measuring temperature of the ice-making tray 120 may be disposed at the ice-making tray 120 that is adjacent to the driving motor.

The ice maker supporter 140 may be fixed to an upper wall of the second storage compartment 13 while supporting the electronic device case 110 and the ice-making tray 120. To this end, in order to fix the ice maker supporter 140 to the upper wall of the second storage compartment 13, a plurality of sliding parts (not shown) may be disposed at one side of the ice maker supporter 140, and a plurality of screw coupling parts 141 may be disposed at the other side of the ice maker supporter 140 that faces the plurality of sliding parts. Also, at least one suspending part (not shown) that fixes a cable 142 to transmit a power or control signal to the driving motor may be disposed on a top surface of the ice maker supporter 140. A connector 143 that is connected to an end of the cable 142 is connected to a power connector 144 positioned at an inner upper wall 13*a* of the second storage compartment 13.

A sliding guide 145 that corresponds to the sliding parts of the ice maker supporter 140 so as to fix the ice maker supporter 140 and a plurality of fastening holes 146 that correspond to the plurality of screw coupling parts 141 of the ice maker supporter 140 may be formed at the inner upper wall 13*a* of the second storage compartment 13.

Also, a water supply pipe 18 to supply water to the ice-making tray 120 may protrude from the i upper wall 13*a* of the second storage compartment 13 downward.

The ice maker supporter 140 may be disposed to surround portions of an upper side and sidewalls of the ice-making tray 120. That is, an electronic device installing part 147 to install the electronic device case 110 may be disposed at a front side of the ice maker supporter 140 positioned in front of the second storage compartment 13, and a rear side supporting part 148 that rotatably supports the ice-making tray 120 may be disposed in rear of the ice maker supporter 140 that faces the front side of the ice maker supporter 140. That is, the ice maker supporter 140 may be disposed to surround the front side, the rear and an upper part of the ice-making tray 120 and to open a lower part of the ice-making tray 120.

The protection cover 200 may be combined with the ice maker supporter 140 so as to cover portions of a lower side of the ice-making tray 120. That is, the protection cover 200 may be disposed to cover portions of the lower part of the ice-making tray 120 positioned on the opposite side in which the ice full lever 150 is disposed, not to be interfered with an operation of the ice full lever 150.

Figure 7:
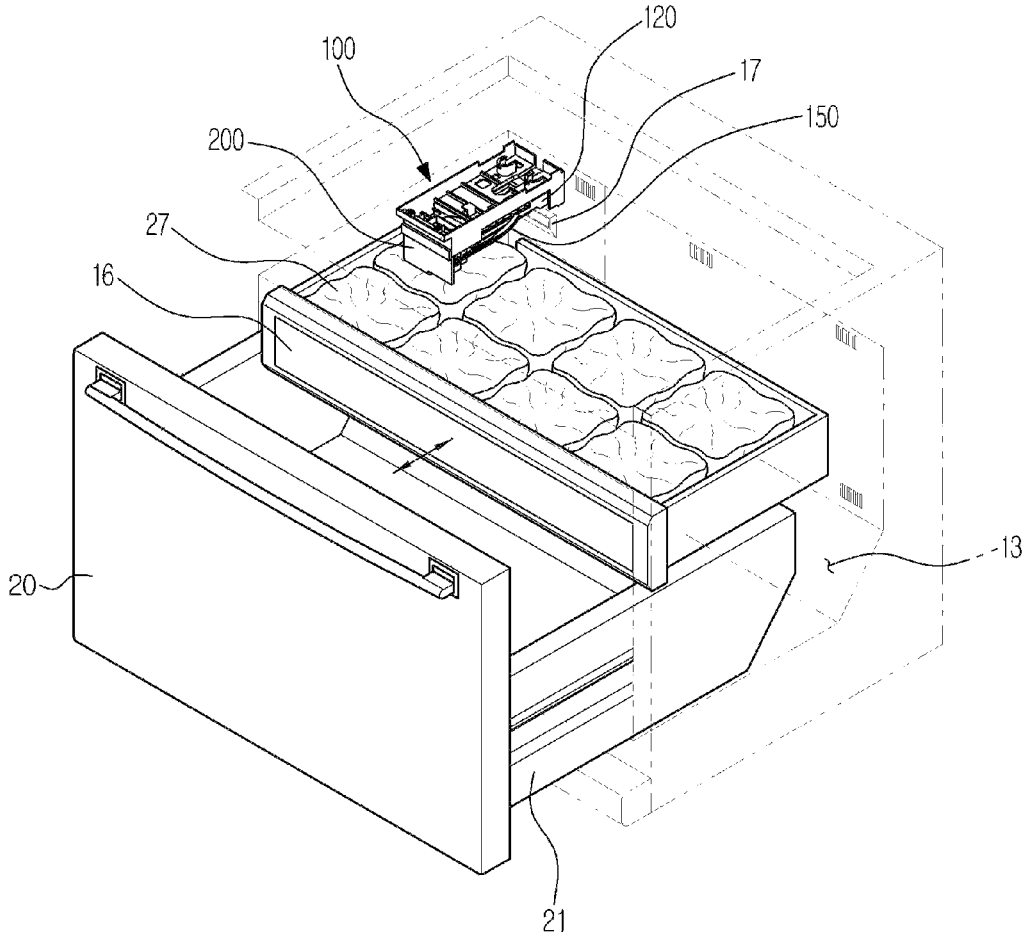
FIG. 7 is a view illustrating interference between an article stored in an accommodation basket and an ice maker when the accommodation basket slides, according to an embodiment of the present disclosure.

The protection cover 200 performs the function of preventing damage of the ice maker 100 as an article (ice or food) 27 stored in the accommodation basket 16 or the ice bank 101 directly interferes with or collides with the components (the temperature sensor 160, the electronic device case 110, and the ice-making tray 120) of the ice maker 100 when the second storage compartment door 20 or the accommodation basket 16 slides in and out of the second storage compartment 13 in a forward/backward direction of the second storage compartment 13, as illustrated in FIG. 7.

That is, since the ice-making tray 120 supported by the ice maker supporter 140 is disposed in a state in which the lower side of the ice-making tray 120 is exposed, the article 27 stored in the ice bank 101 or the storage space of the accommodation basket 16 from which the ice bank 101 is separated, interferes with and collides with the lower side of the ice-making tray 120, the temperature sensor 160, or the electronic device case 110 by opening the second storage compartment door 20 such that damage of the ice maker 100 occurs. However, the protection cover 200 according to an embodiment of the present disclosure causes the article 27 to prevent collision or interference with the ice maker 100, thereby preventing damage of the ice maker 100 in advance.

The protection cover 200 may include a front side part 210 that surrounds portions of a front side of the ice maker supporter 140 at which the electronic device case 110 is installed, a cover part 220 that covers a lower part of the ice-making tray 120, and a rear side part 230 that is supported by a rear side supporting part 148 formed at a rear side of the ice maker supporter 140. Also, the protection cover 200 may be separably combined with the ice maker supporter 140. To this end, hook-shaped hanging parts (not shown) may be provided at the front side part 210 and the rear side part 230 of the protection cover 200, respectively, and may be hung in and supported by the electronic device installing part 147 and the rear side supporting part 148 of the ice maker supporter 140.

Also, inclination guide parts 240 and 250 may be disposed in portions connecting between the front side part 210 and the cover part 220 of the protection cover 200 and between the rear side part 230 and the cover part 220 of the protection cover 200 and may be downwardly inclined. This is because, when the second storage compartment door 20 or the accommodation basket 16 slides in and out of the second storage compartment 13 in the forward/backward direction of the second storage compartment 13, even though the lower side of the ice-making tray 120 is interfered with the article (ice or food) 27 stored in the accommodation basket 16 or the ice bank 101, the article 27 is smoothly guided to a lower side of the protection cover 200 via the inclination guide parts 240 and 250.

Figure 6:
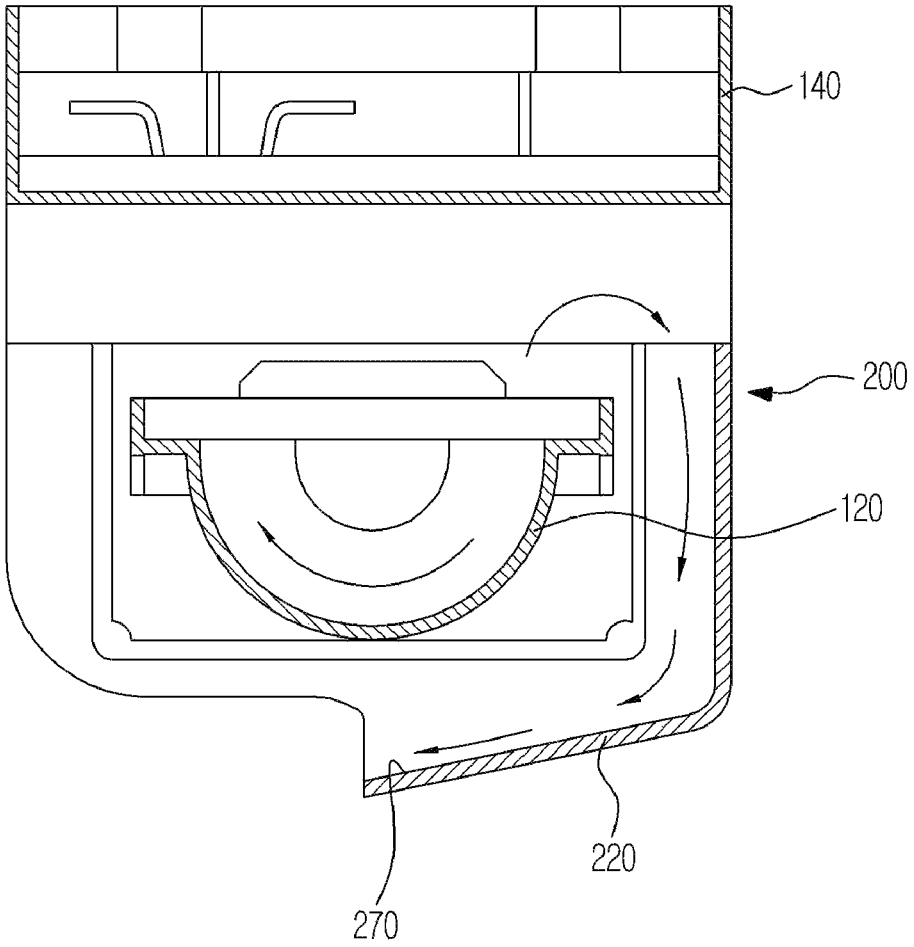
FIG. 6 is a cross-sectional view of the ice maker of FIG. 2.

The cover part 220 of the protection cover 200 may be formed to cover portions of the lower side of the ice-making tray 120 in a position corresponding to a drop route of ice separated from the ice-making tray 120 so as to form the drop route on which ice separated from the ice-making tray 120 drops into the ice bank 101 due to a twisting operation of the ice-making tray 120, as illustrated in FIG. 6. Also, the cover part 220 of the protection cover 200 may be disposed spaced apart from a bottom surface of the ice-making tray 120 by a predetermined distance, and a downward inclination surface 270 may be formed at the cover part 220 of the protection cover 200 and may be downwardly inclined so that ice dropping into the cover part 220 may slide downward.

Hereinafter, operation and effect of the ice maker 100 according to an embodiment of the present disclosure will be described.

First, referring to FIGS. 2 and 4, if the ice full lever 150 rotates downward and detects that whether the ice bank 101 is full or not, the controller (not shown) supplies water to the ice-making tray 120 via the water supply pipe 18, and the ice-making tray 120 is cooled by supplied cold air and generates ice.

The controller receives the temperature of the ice-making tray 120 detected by the temperature sensor 160 attached to the ice-making tray 120, and if the temperature of the ice-making tray 120 reaches a set temperature, the controller controls an operation of the driving motor for ice separation.

Due to the operation of the driving motor, the ice-making tray 120 allows ice to drop into the ice bank 101 positioned at the lower part of the ice-making tray 120 after separating ice from the ice-making tray 120 due to twisting. In this case, ice that drops from the ice-making tray 120 is guided by the cover part 220 of the protection cover 200 and moves downward.

As illustrated in FIG. 7, when the ice full lever 150 that detects the quantity of ice stored in the ice bank 101 is broken, or when the user stacks another article (ice spoon) in the ice bank 101 or does not use the ice-making device 70, if the article 27 is accommodated at an predetermined height or more in a position in which the ice bank 101 is positioned in a state in which the ice bank 101 is separated from the storage space 16*a* of the accommodation basket 16, the article 27 stacked in the accommodation basket 16 that slides in and out of the second storage compartment 13 due to an opening/closing operation of the second storage compartment door 20 interferes with or collides with the ice maker 100 installed at the upper part of the second storage compartment 13 and thus may cause damage of the ice maker 100. However, the article 27 accommodated in the accommodation basket 16 or the ice bank 101 at an appropriate height or more is guided to the lower side of the protection cover 200 by the inclination guide parts 240 and 250 of the protection cover 200 when the accommodation basket 16 slides in and out of the second storage compartment 13 such that interference and collision with the ice-making tray 120, the electronic device case 110, or the temperature sensor 160 is prevented and damage of the ice maker 100 may be prevented.

As described above, in a refrigerator according to the one or more embodiments of the present disclosure, an article stored in a storage container capable of sliding in a freezer compartment is prevented from interfering with an ice maker so that damage of the ice maker caused by the article accommodated in the storage container when the storage container slides in and out of the freezer compartment can be prevented.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator with an icemaker and an icemaker protection cover comprising:

a freezer compartment;

a drawer door that is capable of sliding in and out of the freezer compartment so as to open and close the freezer compartment and has a storage box in which a first article is stored; and an ice maker that is installed at an upper side of the freezer compartment, wherein the ice maker comprises:

an ice maker supporter that is combined with an upper wall of the freezer compartment;

an electronic device case which is supported by the ice maker supporter and in which a driving motor is embedded;

an ice-making tray that is supported by the electronic device case and the ice maker supporter to be rotatable by the driving motor;

a temperature sensor that is installed adjacent to the ice-making tray so as to detect temperature of the ice-making tray; and a protection cover that is directly coupled with the ice maker supporter so as to cover at least a portion of a lower part of the ice-making tray and prevent a second article stacked in the lower part of the ice-making tray from interfering with at least one of the ice-making tray, the temperature sensor, and the electronic device case when the drawer door slides, wherein the protection cover comprises a front side part that is coupled with the ice maker supporter so as to cover at least a portion of a front of the electronic device case, a cover part that covers at least a portion of the lower part of the ice-making tray, and a rear side part that faces the front side part and is supported at a rear side of the ice maker supporter, and wherein the front side part is in direct contact with a front part of the ice maker supporter and the rear side part is in direct contact with a rear part of the ice maker supporter.

2. The refrigerator according to claim 1, wherein the protection cover further comprises downwardly-inclined inclination guide parts that are disposed in corner regions of lower end parts of the front side part and the rear side part.

3. The refrigerator according to claim 2, wherein the protection cover is separably combined with the ice maker supporter.

4. The refrigerator according to claim 2, wherein the cover part is spaced apart from a bottom surface of the ice-making tray by a predetermined distance, and a downwardly-inclined surface is formed at the cover part and guides ice separated from the ice-making tray downward.

5. The refrigerator according to claim 2, wherein the ice-making tray is formed as a resin injection molding structure, and ice generated in the ice-making tray is separated by twisting due to a rotational force of the driving motor.

6. The refrigerator according to claim 2, further comprising:

an accommodation basket that is slidably installed at an upper part of the storage box; and an ice bank which is separably accommodated in a storage space of the accommodation basket and in which ice dropping from the ice-making tray is stored.

7. The refrigerator according to claim 6, wherein cutting parts having sizes corresponding to the ice maker are formed at rear walls of the accommodation basket and the ice bank so as to prevent collision with the ice maker when the accommodation basket slides.

8. The refrigerator according to claim 2, wherein the cover part of the protection cover is formed in a position corresponding to a drop route of ice separated from the ice-making tray so as to form the drop route on which ice separated from the ice-making tray drops due to a twisting operation of the ice-making tray.

9. A refrigerator with an icemaker and an icemaker protection cover comprising:

a freezer compartment;

an ice maker comprising an ice maker supporter that is combined with an upper side of the freezer compartment and an ice-making tray that is supported by the ice maker supporter and is formed as a resin injection molding structure in which generated ice is separated by twisting due to a rotational force of a driving motor;

an accommodation basket which is installed to be slidable from a lower part of the ice-making tray in a forward and backward direction of the freezer compartment and in which an article is stored; and a protection cover including a front side part that is coupled with the ice maker supporter so as to cover at least a portion of a front of the electronic device case, a cover part that covers at least a portion of the lower part of the ice-making tray, and a rear side part that faces the front side part and is supported at a rear side of the ice maker supporter, and wherein inclination guide parts that guide the article to a lower side of the protection cover when the accommodation basket slides and a lower side of the ice-making tray is interfered with the article accommodated in the accommodation basket, are disposed in corner regions of front and rear lower end parts of the protection cover, and wherein the front side part is in direct contact with a front part of the ice maker supporter and the rear side part is in direct contact with a rear part of the ice maker supporter.

* * * * *